US011331686B2

(12) United States Patent
Tsui

(10) Patent No.: US 11,331,686 B2
(45) Date of Patent: May 17, 2022

(54) SYSTEM AND METHOD FOR APPLYING MATERIAL TO A BICYCLE FRAME

(71) Applicant: Carlisle Fluid Technologies, Inc., Scottsdale, AZ (US)

(72) Inventor: Se Seng Tsui, Tokyo (JP)

(73) Assignee: Carlisle Fluid Technologies, Inc., Scottsdale, AZ (US)

( * ) Notice: Subject to any disclaimer, the term of this patent is extended or adjusted under 35 U.S.C. 154(b) by 600 days.

(21) Appl. No.: 16/192,017

(22) Filed: Nov. 15, 2018

(65) Prior Publication Data

US 2019/0151883 A1 May 23, 2019

Related U.S. Application Data

(60) Provisional application No. 62/589,816, filed on Nov. 22, 2017.

(51) Int. Cl.

| | |
|---|---|
| ***B05B 13/04*** | (2006.01) |
| ***B05B 12/12*** | (2006.01) |
| ***B05B 12/00*** | (2018.01) |
| ***B05B 15/70*** | (2018.01) |
| ***B05B 13/02*** | (2006.01) |

(Continued)

(52) U.S. Cl.

CPC ..... *B05B 13/0431* (2013.01); *B05B 12/004* (2013.01); *B05B 12/124* (2013.01); *B05B 13/0278* (2013.01); *B05B 13/0285* (2013.01); *B05B 13/0457* (2013.01);

(Continued)

(58) Field of Classification Search

USPC ..... 118/321, 323, 679–682, 313, 315, 118/696–698

See application file for complete search history.

(56) References Cited

U.S. PATENT DOCUMENTS 4,931,322 A 6/1990 Yamamoto et al.
5,273,059 A 12/1993 Gross et al.

(Continued)

FOREIGN PATENT DOCUMENTS

CN 104607347 A 5/2015
CN 105107654 A 12/2015

(Continued)

OTHER PUBLICATIONS

Chinese Office Action for CN Application No. 201880086345.X, dated Feb. 10, 2021, 3 pgs.

(Continued)

*Primary Examiner* — Yewebdar T Tadesse

(74) *Attorney, Agent, or Firm* — Fletcher Yoder, P.C.

(57) ABSTRACT

A method for applying material to a bicycle frame includes determining, via a controller, at least one physical dimension of the bicycle frame. The method also includes determining, via the controller, a distance setting between at least two material applicators. In addition, the method includes determining, via the controller, a pattern size of material sprayed onto the bicycle frame by each of the at least two material applicators. Further, the method includes adjusting, via the controller, a position setting of the at least two material applicators based at least in part on the distance setting and pattern size. Moreover, the method includes applying, via the controller, material onto the bicycle frame through the at least two material applicators.

20 Claims, 4 Drawing Sheets

(51) Int. Cl.
*B05B 15/68* (2018.01)
*B05B 3/10* (2006.01)

(52) U.S. Cl.
CPC ..... *B05B 15/68* (2018.02); *B05B 15/70* (2018.02); *B05B 3/1092* (2013.01); *B05B 12/122* (2013.01)

(56) References Cited

U.S. PATENT DOCUMENTS

| | | | | |
|---|---|---|---|---|
| 2005/0166413 | A1* | 8/2005 | Crampton | B25J 13/088 33/503 |
| 2013/0134236 | A1 | 5/2013 | Uematsu et al. | |
| 2016/0129466 | A1* | 5/2016 | Turnbull | B25J 9/1679 427/8 |

FOREIGN PATENT DOCUMENTS

| | | | |
|---|---|---|---|
| CN | 205436134 | U | 8/2016 |
| GB | 2227189 | A | 7/1990 |
| GN | 104112030 | A | 10/2014 |
| GN | 105903615 | A | 8/2016 |
| JP | S57165268 | U | 10/1982 |
| JP | H01297169 | A | 11/1989 |
| JP | H0747314 | A | 2/1995 |
| JP | 2000237651 | A | 9/2000 |
| JP | 2004230260 | A | 8/2004 |
| WO | 2013175392 | A1 | 11/2013 |
| WO | 2017182604 | A1 | 10/2017 |

OTHER PUBLICATIONS

Seriani, S., et al., "Automatic Path-Planning Algorithm for Realistic Decorative Robotic Painting," Automation in Construction, Oct. 29, 2014, 12 pgs.

Vincze, M., et al., "Automatic Robotic Spray Painting of Law Volume High Variant Parts," Proceedings of the 33rd ISR, XP55572293A, Oct. 7-11, 2002, 7 pgs.

International Search Report and Written Opinion for PCT Application No. PCT/US2018/061422 dated Apr. 5, 2019, 19 pgs.

Lin, Chyi-Yeu et al.. Advanced Spraying Task Strategy for Bicycle-Frame Based on Geometrical Data of Workpiece, 2015 International Conference on Advanced Robotics (ICAR), IEEE, Jul. 27, 2015, 6 pgs.

European Office Action for EP Application No. 18839558.6, dated May 10, 2021, 6 pgs.

Chinese Office Action for CN Application No. 201880086345.X, dated Aug. 12, 2021, 8 pgs.

Japanese Office Action for JP Application No. 2020-528100, dated Sep. 7, 2021, 2 pgs.

* cited by examiner

SYSTEM AND METHOD FOR APPLYING MATERIAL TO A BICYCLE FRAME

CROSS-REFERENCE TO RELATED APPLICATION

This application claims priority to and benefit of U.S. Provisional Patent Application No. 62/589,816, entitled "SYSTEM AND METHOD FOR APPLYING MATERIAL TO A BICYCLE FRAME," filed Nov. 22, 2017, which is herein incorporated by reference in its entirety.

BACKGROUND

The present disclosure relates generally to a system and method for applying material to a bicycle frame.

During the manufacture of bicycles, the frames of the bicycles are constructed and frequently coated in material (e.g., paint, protective film, polyurethane, powder, etc.). Applying an even layer of material to the frame of the bicycle is desired to increase the durability and aesthetics of the paint. Utilizing an automated system may reduce the time to apply material, and/or provide a more consistent application of material. The frame of the bicycle may include crevices that may increase the difficulty of applying an even layer of material. In some cases, the automated system may not coat the entire frame in material, and/or the automated system may apply an uneven layer of material. In such cases, additional material may be applied to the frame of the bicycle. Accordingly, it may be beneficial to improve the application of material to bicycle frames.

BRIEF DESCRIPTION

Certain embodiments commensurate in scope with the original claims are summarized below. These embodiments are not intended to limit the scope of the claims, but rather these embodiments are intended only to provide a brief summary of possible forms of the systems and techniques described herein. Indeed, the presently disclosed embodiments may encompass a variety of forms that may be similar to or different from the embodiments set forth below.

In a first embodiment, a method for applying material to a bicycle frame includes determining, via a controller, at least one physical dimension of the bicycle frame. The method also includes determining, via the controller, a distance setting between at least two material applicators. In addition, the method includes determining, via the controller, a pattern size of material sprayed onto the bicycle frame by each of the at least two material applicators. Further, the method includes adjusting, via the controller, a position setting of the at least two material applicators based at least in part on the distance setting and pattern size. Moreover, the method includes applying, via the controller, material onto the bicycle frame through the at least two material applicators.

In a second embodiment, a system for applying paint onto a bicycle frame includes a controller configured to determine at least one physical dimension of the bicycle frame. The controller is also configured to determine a distance setting between at least two paint applicators. In addition, the controller is configured to determine a pattern size of paint sprayed onto the bicycle frame by each of the at least two paint applicators. Moreover, the controller is configured to adjust a position setting of the at least two paint applicators based at least in part on the distance setting and pattern size.

Further, the controller is configured to apply paint onto the bicycle frame through the at least two paint applicators.

In a third embodiment, a system for applying paint onto a bicycle frame includes an automated robot system that includes multiple arms and multiple joints. The automated robot system is configured to adjust a position setting of a paint applicator system by moving at least one of the multiple arms or at least one of the multiple joints. The system also includes a paint applicator system coupled to the automated robot system, and the paint applicator system includes at least two paint applicators. The paint applicator system also includes at least two mounting arms configured to couple to a respective one of the at least two paint applicators. In addition the paint applicator system includes at least one sliding arm configured to couple to the at least two mounting arms, and the at least one sliding arm is configured to enable the at least two mounting arms to translate with respect to one another.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments.

During the construction of a bicycle, a bicycle frame is constructed. Then the bicycle frame is frequently coated in at least one layer of material (e.g., paint, protective film, polyurethane, powder, etc.). As described herein, the term paint may refer to any suitable coating material, including paint, protective film, polyurethane, powder, etc. that may be applied to a bicycle. Bicycle frames often have recesses and rounded surfaces which can complicate the application of paint to the bicycle frame. Further, it is beneficial to apply a layer of paint having an even thickness to improve the durability and aesthetics of the paint. Further, paint application systems frequently employ touch-up painting for spots that did not receive an even layer of paint, which may utilize additional workers and time. Moreover, reducing the time to paint the bicycle frames may reduce the manufacturing time of the bicycle, which may reduce costs associated with manufacturing the bicycle. Therefore, it is desirable to provide a paint application system to improve the application of the paint on bicycle frames to improve the durability and aesthetics of the paint, and to reduce time spent applying the paint and touching-up the paint.

Accordingly, embodiments of the present disclosure generally relate to a system and method for paint application. For example, some embodiments include an automated paint applicator that enables a consistent flow of paint across the surface of the bicycle frame. This autonomous paint applicator may improve the quality of the paint applied to the bicycle frame while reducing the time to apply paint to the bicycle frame.

Figure 1:
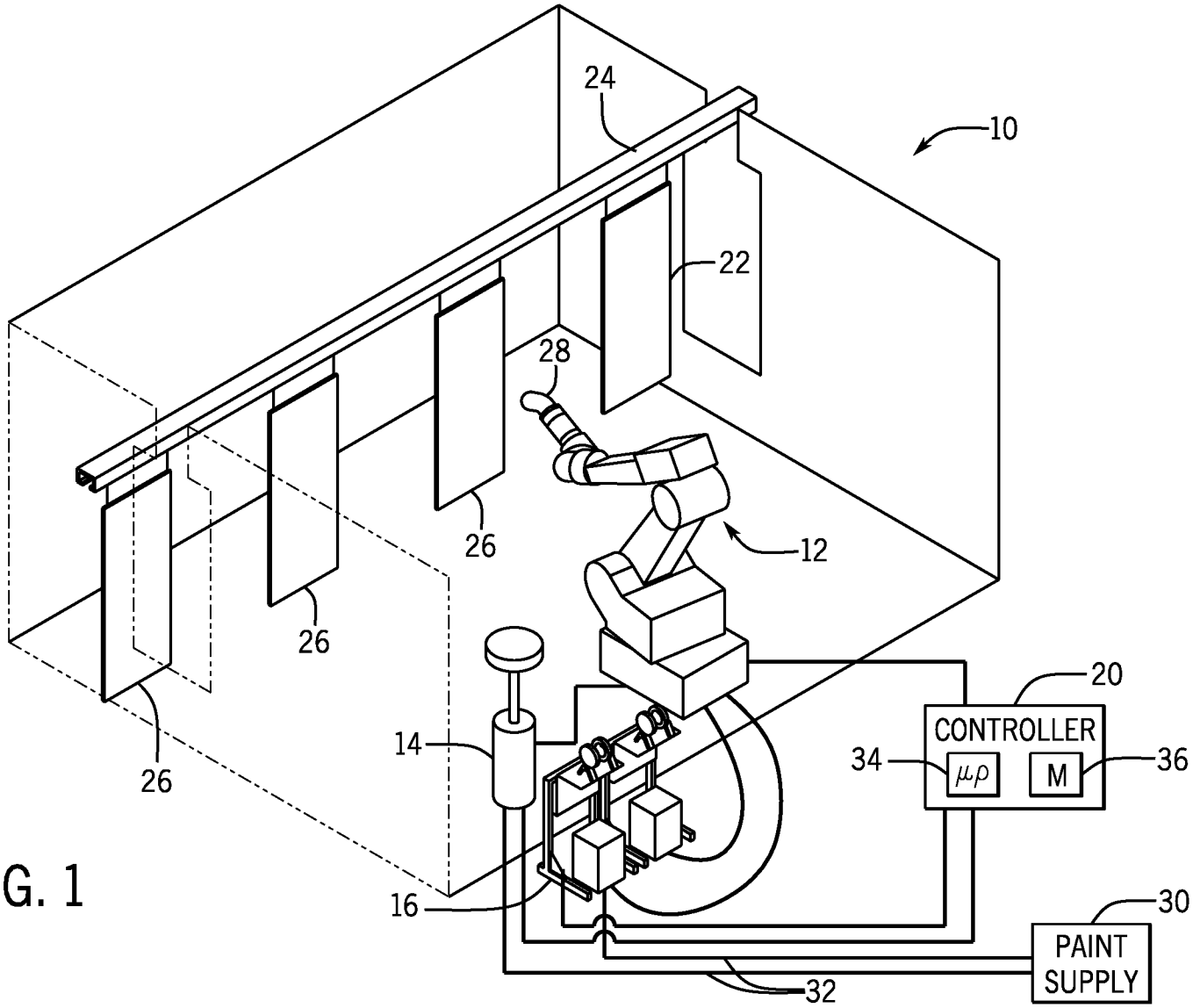
FIG. 1 is a perspective view of an embodiment of an automated material application system, in accordance with an aspect of the present disclosure.

With the foregoing in mind, FIG. 1 is a perspective view of an embodiment of an automated paint application system 10, which may include various improvements in the paint applicator and methods for using the paint applicator as discussed in further detail below. In the present embodiment, the automated paint application system 10 includes a robot system 12, a first pump system 14, a second pump system 16, a paint supply 30, and a controller 20. During the manufacture of a component (e.g., a bicycle), the component may be coated in paint (e.g., by the automated paint application system 10). As such, an unpainted surface 22 travels along a conveyor system 24 to pass through various steps of a manufacturing process. In the present embodiment, the unpainted surface 22 travels through a painting step where the unpainted surface 22 is coated in paint and becomes a painted surface 26. The automated paint application system 10 applies paint to the unpainted surface 22 as the unpainted surface 22 travels by the automated paint application system 10 on the conveyor system 24. For example, in the present embodiment, the robot system 12 includes a paint applicator 28 (e.g., an atomizer) through which a spray of paint flows. Accordingly, as the unpainted surface 22 travels by the robot system 12, the paint applicator 28 sprays paint onto the unpainted surface 22. At the same time, the robot system 12 is configured to move the paint applicator 28 with six degrees of freedom to improve the quality of paint applied to the unpainted surface 22. In some embodiments, the robot system 12 may move the paint applicator with fewer degrees of freedom, including 1, 2, 3, 4, or 5 degrees of freedom. After the automated paint application system 10 applies paint to the unpainted surface 22, the unpainted surface 22 becomes a painted surface 26, and continues to another portion of the manufacturing process.

In some embodiments, the first pump system 14, the second pump system 16, or both may be utilized to aid the robot system 12 in applying paint. For example, the first pump system 14, the second pump system 16, or both may be fluidly coupled to a paint supply 30 via one or more paint supply lines 32 to provide a flow of paint to the robot system 12, and through the paint applicator 28. The first pump system 14 and the second pump system 16 may include any suitable type of pump, including a gear pump, a diaphragm pump, a centrifugal pump, etc.

Further, the controller 20 (e.g., an electronic and/or processor-based controller) may be utilized to govern operation of the paint application system 10. The controller 20 may independently control operation of the paint application system 10 by electrically communicating with the robot system 12, the first pump system 14, the second pump system 16, and/or the conveyor system 24. For example, the controller 20 may control the position and movements of the paint applicator 28 on the robot system 12. Further, the controller 20 may control the movement speed of the conveyor system 24 to increase or decrease the movement speed of the unpainted surface 22 and the painted surfaces 26. The controller 20 may control the first pump system 14 and/or the second pump system 16 to change the flow rate of paint to the robot system 12.

The controller 20 may include a distributed control system (DCS) or any computer-based workstation that is fully or partially automated. For example, the controller 20 may include a processor(s) 34 (e.g., a microprocessor(s)) that may execute software programs to perform the disclosed techniques. Moreover, the processor 34 may include multiple microprocessors, one or more "general-purpose" microprocessors, one or more special-purpose microprocessors, and/or one or more application specific integrated circuits (ASICS), or some combination thereof. For example, the processor 34 may include one or more reduced instruction set (RISC) processors. The controller 20 may include a memory device 36 for storing instructions executable by the processor 34. Data stored on the memory device 36 may include, but is not limited to, movement algorithms of the robot system 12, first pump system 14 parameters, second pump system 16 parameters, conveyor system 24 parameters, etc. of the paint application system 10. The memory device 36 may include a tangible, non-transitory, machine-readable medium, such as a volatile memory (e.g., a random access memory (RAM)) and/or a nonvolatile memory (e.g., a read-only memory (ROM), flash memory, a hard drive, or any other suitable optical, magnetic, or solid-state storage medium, or a combination thereof). Further, the controller 20 may include multiple controllers spread out across the paint application system 10 (e.g., each of the robot system 12, the first pump system 14, the second pump system 16, and the conveyor system 24 may include one or more controllers).

Figure 2:
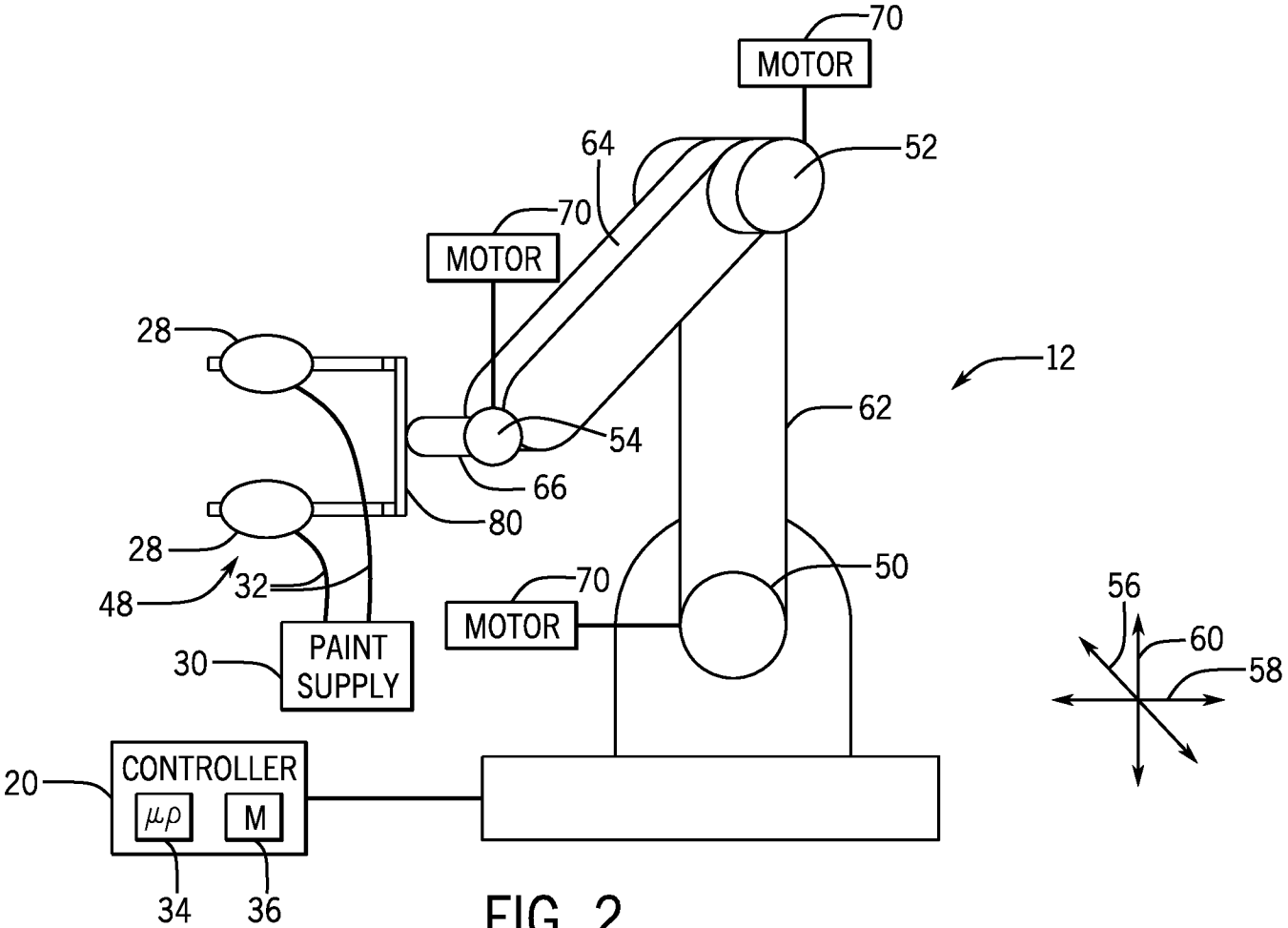
FIG. 2 is a side view of an embodiment of a robot arm having two material applicators that may be utilized in the automated material application system of FIG. 1, in accordance with an aspect of the present disclosure.

FIG. 2 is a side view of an embodiment of the robot system 12 with an applicator system 48 that includes two paint applicators 28. The robot system 12 includes a first joint 50, a second joint 52, and a third joint 54 that may rotate about a lateral axis 56, a longitudinal axis 58, and/or a vertical axis 60. Further, the robot system includes a first arm 62 that couples the first joint 50 and the second joint 52, a second arm 64 that couples the second joint 52 and the third joint 54, and a third arm 66 that couples the third joint 54 and the applicator system 48. As the first joint 50, the second joint 52, and/or the third joint 54 rotate, the first arm 62, the second arm 64, and/or the third arm 66 move in the lateral direction 56, the longitudinal direction 58, and/or the vertical direction 60. In some embodiments, the robot system 12 may include any suitable number of joints and/or arms, including 1, 2, 4, 5, 6, or more.

Further, as discussed above, the robot system 12 may be electrically coupled to the controller 20, which may control one or more motors 70 (e.g., servomotors, electric motors, etc.) to control the rotation of the first joint 50, the second joint 52, and/or the third joint 54 to control the movement of the robot system 12. In some embodiments, the robot system 12 may be controller by an operator using an input device (e.g., a joystick, mouse and keyboard, etc.).

The applicator system 48 is coupled to the third arm 66. Accordingly, the robot system 12 may control the three dimensional position of the applicator system 48 by controlling the movement of the third arm 66. Movement of the applicator system 48 may affect the characteristics of the paint sprayed onto the unpainted surface. For example, if the paint applicator system 48 is moved further from the unpainted surface, the paint would be sprayed onto a larger area of the unpainted surface. Conversely, if the paint applicator system 48 is moved closer to the unpainted surface, the paint would be sprayed onto a smaller area of the unpainted surface. Further, the amount of time the paint applicator system 48 applies paint to a particular area of the unpainted surface may be proportional to the amount of paint deposited onto the unpainted surface. For example, spending a longer time applying paint to a particular area of the unpainted surface increase the amount of paint deposited onto the particular area of the unpainted surface.

As discussed above, the applicator system 48 may receive a flow of paint through one or more paint supply lines 32 from the paint supply 30. The flow rate of paint through the applicator system 48 may affect the amount of paint deposited onto the unpainted surface. For example, a higher flow rate of paint will increase the amount of paint deposited onto the unpainted surface.

In the present embodiment, the applicator system 48 includes two paint applicators 28 and a bracket system 80 that couples to the two paint applicators 28 and the third arm 66. As discussed below, the bracket system 80 may enable the two applicators to move relative to one another to alter the characteristics of the spray pattern of the paint. Further, each paint applicator 28 may be individually controlled to change the characteristics of the spray pattern. For example, a nozzle of the paint applicator 28 may be adjusted to change the size and/or shape of the spray pattern.

Figure 3:
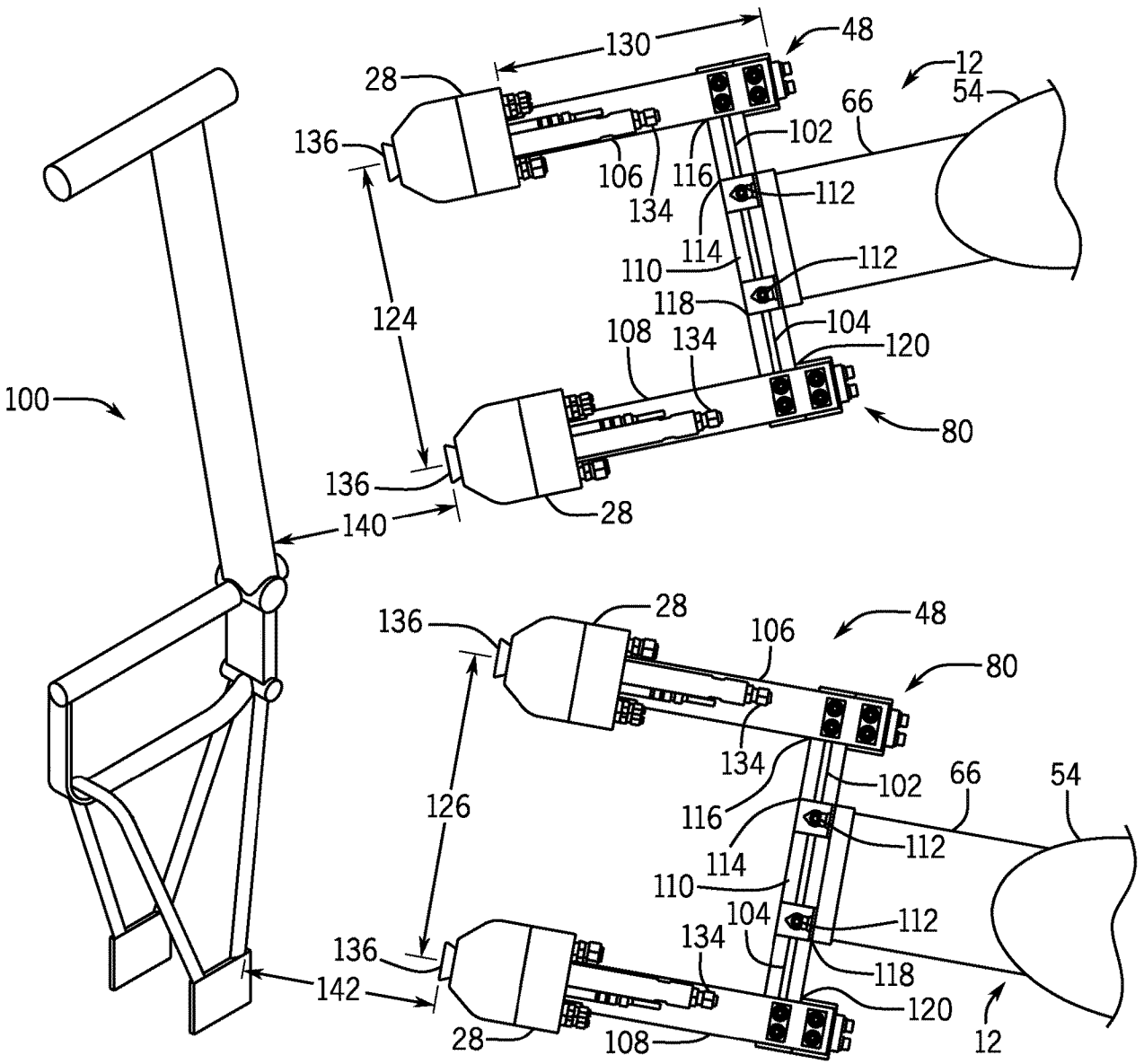
FIG. 3 is a side view of an embodiment of the two material applicators of FIG. 2 in multiple positions relative to a bicycle frame, in accordance with an aspect of the present disclosure.

FIG. 3 is a side view showing the applicator system 48 in multiple positions relative to a bicycle frame 100. As discussed above, the applicator system 48 is coupled to the robot arm 12 at the third arm, which is coupled to the third joint 54, and movement of the third arm 66 controls the movement of the applicator system 48. In the present embodiment, the applicator system 48 includes two paint applicators 28, a first sliding arm 102, a second sliding arm 104, a first mounting arm 106, a second mounting arm 108, and a mounting bracket 110. In operation, the applicator system 48 moves relative to the bicycle frame 100. As the applicator system 48 is moving, paint is sprayed through the two paint applicators 28 onto the bicycle frame 100.

In the present embodiment, the mounting bracket 110 is rigidly coupled to the third arm 66 by two fasteners 112 (e.g., bolts, screws, welds, etc.). In some embodiments, the mounting bracket 110 may be rotatably coupled to the third arm. The first sliding arm 102 is coupled to the mounting bracket 110 at a first end 114 and to the first mounting arm 106 at a second end 116. The second sliding arm 104 is coupled to the mounting bracket 110 at a first end 118 and to the second mounting arm 108 at a second end 120. Further, each of the first mounting arm 106 and the second mounting arm 108 are coupled to one of the two paint applicators 28. In the present embodiment, the two paint applicators 28 are rigidly coupled to the respective mounting arm. In some embodiments, the one or both of the two paint applicators 28 may be rotatably coupled to the respective mounting arm. Further, in some embodiments, one or both of the two paint applicators 28 may be slideably coupled to the respective mounting arm, such that a slideably coupled paint applicator 28 may translate along a length 130 of the respective mounting arm. Each of the first sliding arm 102 and the second sliding arm 104 enable the respective first mounting arm 106 and the second mounting arm 108 to translate toward and away from the mounting bracket 110, which enables the paint applicators 28 to be at different distances from each other. As illustrated, the two paint applicators 28 may be at a first distance 124 from each other, or at a second distance 126 from each other. It should be appreciated that the distance between the two paint applicators 28 may be adjusted to achieve any suitable distance. In some embodiments, the first distance 124 and/or the second distance 126 may be determined based on the area covered by paint sprayed by each paint applicator 28, such that the area covered by paint sprayed by each paint applicator 28 intersect one another.

Further, the translation of the first mounting arm 106 and the second mounting arm 108 may be controlled manually by an operator, or automatically by a motor (e.g., a servomotor, an electric motor, etc.) and a controller (e.g., the controller 20). In some embodiments, the translation of the first mounting arm 106 and the second mounting arm 108 may be prevented while the third arm 66 is in motion, and in some embodiments, the translation of the first mounting arm 106 and the second mounting arm 108 may be enabled while the third arm 66 is in motion. In some embodiments, the first sliding arm 102 and the second sliding arm 104 may be integral to the mounting bracket 110 and/or the first sliding arm 102 and the second sliding arm 104 may be a single sliding arm extending between the first mounting arm 106 and the second mounting arm 108. Further, the first sliding arm 102 and the second sliding arm 104 may include any suitable structure that enables translation, including a drawer slide, rail slide, etc.

Each of the two paint applicators 28 includes an inlet 134 that may couple to a cable (e.g., a fiber optic cable) for controlling certain aspects of the paint applicators 28. Each of the two paint applicators 28 also includes an outlet nozzle 136 through which a flow of paint may exit the respective paint applicator 28. As the flow of paint travels through the paint applicator 28 and out through the outlet nozzle 136, the flow of paint may atomize into a fine mist and be sprayed onto the bicycle frame 100 to form a layer of paint. The outlet nozzle 136 may alter the shape of the sprayed paint and the amount of area of the bicycle frame 100 that is covered in paint. Further, the distance between the paint applicator 28 and the bicycle frame 100 may also affect the area covered by paint. As illustrated, the paint applicators 28 may be at a first distance 140 from the bicycle frame 100, or at a second distance 142 from the bicycle frame 100. The first distance 140 and the second distance 142 may be equal to each other, or the first distance 140 and the second distance 142 may be different from each other. In some embodiments, causing the first distance 140 to be equal to the second distance 142 may cause the paint sprayed onto the bicycle frame 100 to have a uniform layer thickness.

Figure 4:
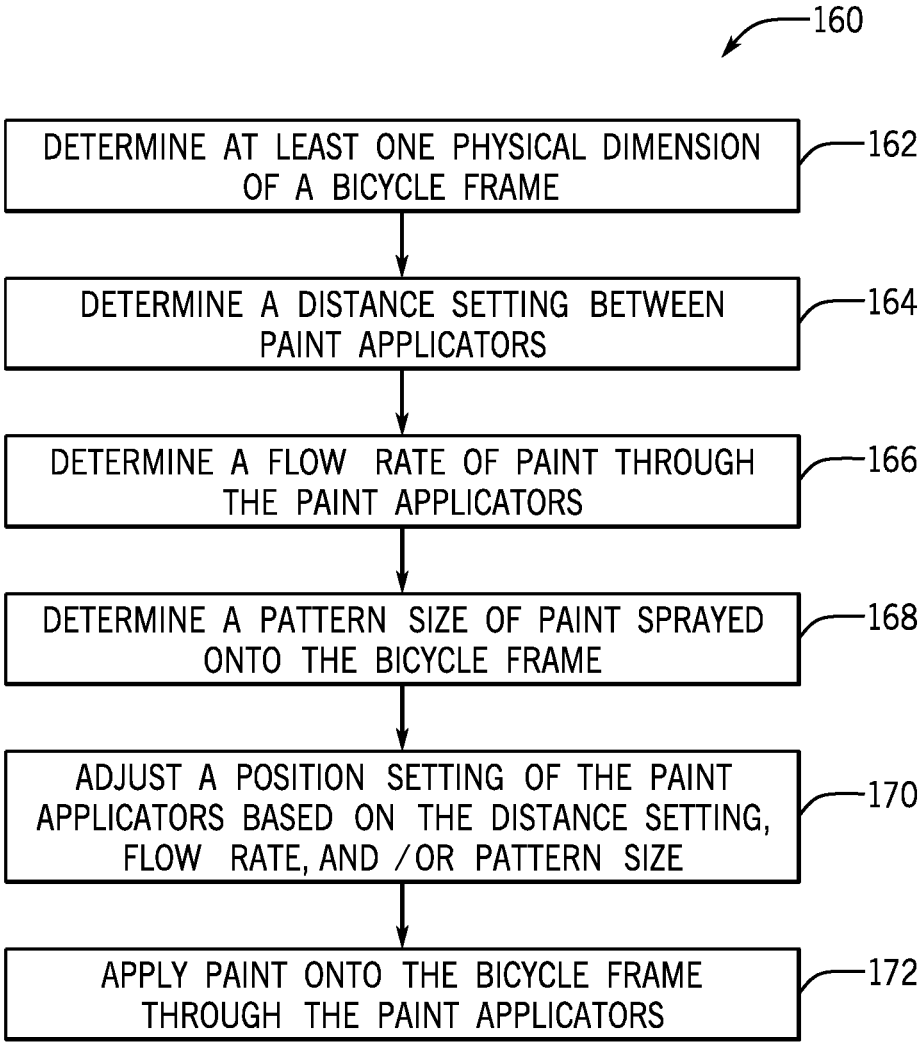
FIG. 4 is an embodiment of a flow chart for automated application of material to a bicycle frame, in accordance with an aspect of the present disclosure.

FIG. 4 is a flowchart of an embodiment of a process 160 for autonomously applying paint to a bicycle frame. The process 160 enables a robot system to apply paint to a bicycle frame with a uniform layer thickness. Although the following process 160 includes a number of operations that may be performed, it should be noted that the process 160 may be performed in a variety of suitable orders (e.g., the order that the operations are discussed, or any other suitable order). All of the operations of the process 160 may not be performed. Further, all of the operations of the process 160 may be performed by the controller.

The controller is configured to determine (block 162) at least one physical dimension of the bicycle frame. The physical dimension may include any suitable dimension, such as length, thickness, width, etc. Further, the physical dimension may be received from a user input.

Then, the controlled determines (block 164) a distance setting between the two paint applicators. As discussed above, the paint applicators may be moved relative to one another by utilizing sliding arms. The distance setting may be determined based, at least in part, on the area covered by paint sprayed from each paint applicator. For example, the determined distance setting may cause the areas covered by paint sprayed from each paint applicator intersect with one another such that there is no unpainted space between the areas covered by paint sprayed from each paint applicator. In some embodiments, the distance setting may be based, at least in part, on the at least one physical dimension. For example, the distance setting may be such that the areas covered by paint sprayed from each paint applicator encompasses some or all of the area along the at least one physical dimension.

Next, the controller determines (block 166) a flow rate of paint through the paint applicators. The flow rate through the paint applicators may affect the area covered by paint sprayed from a corresponding paint applicator. Further, the flow rate of paint through the paint applicators may affect the thickness of the layer of paint applied by the paint applicators. The flow rate of paint through the paint applicators may also affect the amount of time that the paint applicators apply paint to the bicycle frame. For example, a higher flow rate of paint will increase the thickness of the layer of paint applied and/or reduce the amount of time that the paint applicators apply paint to the bicycle frame.

The controller determines (block 168) a pattern size of paint sprayed onto the bicycle frame. The pattern size is the amount of area covered by paint sprayed through each of the paint applicators. In some embodiments, the pattern size may be adjusted by changing the outlet nozzle setting. For example, the outlet nozzle may be narrowed, which may decrease the pattern size, or the outlet nozzle may be widened, which may increase the pattern size. In some embodiments, the pattern size may be adjusted by changing the distance between the paint applicators and the bicycle frame. For example, increasing the distance between the paint applicators and the bicycle frame may increase the pattern size and decrease the thickness of the layer of paint applied to the bicycle frame. Further, decreasing the distance between the paint applicators and the bicycle frame may decrease the pattern size and increase the thickness of the layer of paint applied to the bicycle frame. In addition, the pattern size may be adjusted by changing a pressure setting of an air flow rate (e.g., the shaping air) through the paint applicators. For example, the pattern size may be inversely proportional to the air flow rate (e.g., higher pressure settings correspond to smaller pattern sizes and lower pressure settings correspond to larger pattern sizes).

Next, the controller may adjust (block 170) a position setting of the paint applicators based, at least in part, on the distance setting, the flow rate of paint, and/or the pattern size. For example, the controller may move the paint applicators closer to or further from the bicycle frame. The controller may move the paint applicators closer to or further from one another. In some embodiments, the controller may determine a travel path for the paint applicators. For example, as the paint applicators are applying paint to the bicycle frame, the controller may adjust the position setting of the paint applicators to move with respect to the bicycle frame while applying paint to the bicycle frame to enable the paint applicators to apply paint to substantially all of the bicycle frame. In some embodiments, the pattern size of the paint applicators may enable the paint applicators to be stationary while applying paint to the bicycle frame.

The controller also applies (block 172) paint onto the bicycle frame through the paint applicators. As discussed above, the paint may be applied while the controller is adjusting (block 170) the position setting of the paint applicators. The controller may cause a flow of paint to enter into the paint applicators, and the paint applicators cause the flow of paint to atomize and flow onto the bicycle frame, thereby applying a layer of paint onto the bicycle frame.

Utilizing a system with two paint applicators that may move with respect to one another may increase the productivity and/or decrease the costs associated with the painting of a bicycle frame. For example, providing paint through two paint applicators may reduce the amount of time to apply paint to a bicycle frame, which may reduce the time to manufacture a complete bicycle. Further, providing paint through two paint applicators that may move while applying paint to the bicycle frame may apply paint with decreased variance in thickness, which may improve the quality and aesthetics of the layer of paint. Utilizing two paint applicators may also reduce the amount of time spent touching up the paint, which may reduce the time to manufacture the complete bicycle and reduce the amount of work to manufacture the complete bicycle. Thus, a system utilizing two paint applicators may increase productivity and quality.

While only certain features of the present disclosure have been illustrated and described herein, many modifications and changes will occur to those skilled in the art. It is, therefore, to be understood that the appended claims are intended to cover all such modifications and changes as fall within the true spirit of the present disclosure.

The invention claimed is:

1. A system for applying paint onto a bicycle frame, comprising:

a controller configured to:

determine at least one physical dimension of the bicycle frame;

determine a distance setting between at least two paint applicators;

determine a pattern size of paint sprayed onto the bicycle frame by each of the at least two paint applicators;

adjust a position setting of the at least two paint applicators based at least in part on the distance setting and pattern size; and apply paint onto the bicycle frame through the at least two paint applicators.

2. The system of claim 1, wherein the controller is configured to adjust a first distance between each of the at least two paint applicators.

3. The system of claim 2, wherein the controller is configured to maintain a second distance between each of the at least two paint applicators.

4. The system of claim 3, wherein the controller is configured to adjust a third distance between the at least two paint applicators and the bicycle frame.

5. The system of claim 4, wherein the controller is configured to maintain a fourth distance between the at least two paint applicators and the bicycle frame.

6. The system of claim 1, wherein the controller is configured to adjust the position setting of the at least two paint applicators and apply paint onto the bicycle frame through the at least two paint applicators simultaneously.

7. The system of claim 1, wherein the controller is configured to adjust the position setting of the at least two paint applicators based at least in part on the pattern size through each of the at least two paint applicators intersecting one another.

8. The system of claim 1, wherein the controller is configured to determine a flow rate of paint through the at least two paint applicators.

9. The system of claim 1, comprising a paint applicator system, wherein the paint applicator system comprises the at least two paint applicators.

10. The system of claim 9, wherein the paint applicator system comprises:

at least two mounting arms, wherein each mounting arm of the at least two mounting arms is coupled to a respective one of the at least two paint applicators; and at least one sliding arm coupled to the at least two mounting arms, wherein the at least one sliding arm is configured to enable the at least two mounting arms to translate with respect to one another.

11. The system of claim 10, wherein the controller is configured to adjust the position setting of the at least two paint applicators and apply paint onto the bicycle frame through the at least two paint applicators simultaneously.

12. The system of claim 11, wherein the controller is configured to adjust the position setting of the at least two paint applicators based at least in part on the pattern size through each of the at least two paint applicators intersecting one another.

13. A system for applying paint onto a bicycle frame comprising:

an automated robot system comprising a plurality of arms and a plurality of joints, wherein the automated robot system is configured to adjust a position setting of a paint applicator system by moving at least one of the plurality of arms or at least one of the plurality of joints; and the paint applicator system coupled to the automated robot system, wherein the paint applicator system comprises:

at least two paint applicators;

at least two mounting arms configured to couple to a respective one of the at least two paint applicators; and at least one sliding arm configured to couple to the at least two mounting arms, wherein the at least one sliding arm is configured to enable the at least two mounting arms to translate with respect to one another.

14. The system of claim 13, wherein each of the at least two paint applicators is configured to receive a flow of paint and atomize the flow of paint to output a mist of paint.

15. The system of claim 13, wherein the paint applicator system comprises a mounting bracket configured to rigidly couple the paint applicator system to at least one arm of the plurality of arms of the automated robot system.

16. The system of claim 13, wherein the paint applicator system is configured to move while applying paint to the bicycle frame.

17. The system of claim 13, comprising a controller configured to:

determine at least one physical dimension of the bicycle frame;

determine a distance setting between the at least two paint applicators; and adjust a position setting of the at least two paint applicators based at least in part on the distance setting.

18. The system of claim 17, wherein the controller is configured to:

determine a pattern size of paint sprayed onto the bicycle frame by each of the at least two paint applicators; and adjust the position setting of the at least two paint applicators based at least in part on the pattern size.

19. The system of claim 18, wherein the controller is configured to adjust the position setting of the at least two paint applicators based at least in part on the pattern size of paint sprayed onto the bicycle frame by each of the at least two paint applicators intersecting one another.

20. The system of claim 18, wherein the controller is configured to adjust a first distance between each of the at least two paint applicators by adjusting the at least one sliding arm.

* * * * *